US006505652B1

(12) United States Patent
Matsushima

(10) Patent No.: US 6,505,652 B1
(45) Date of Patent: Jan. 14, 2003

(54) SLIDE FASTENER TAPE

(75) Inventor: Hideyuki Matsushima, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/506,663

(22) Filed: Feb. 17, 2000

(30) Foreign Application Priority Data

Feb. 26, 1999 (JP) ..... 11-049920

(51) Int. Cl.[7] ..... D03D 3/00
(52) U.S. Cl. ..... 139/384 B; 24/381; 24/392
(58) Field of Search ..... 139/384 B; 24/381, 24/392

(56) References Cited

U.S. PATENT DOCUMENTS 4,313,245 A * 2/1982 Yamaguchi ..... 139/384 B
5,069,952 A * 12/1991 Gruenenfelder ..... 139/384 B

FOREIGN PATENT DOCUMENTS

| | | |
|---|---|---|
| FR | 1 566 806 | 5/1969 |
| FR | 2 427 804 | 1/1980 |
| GB | 1221144 | 4/1917 |
| GB | 2 062 035 | 5/1981 |
| GB | 2 072 743 | 10/1981 |

* cited by examiner

*Primary Examiner*—John J. Calvert
*Assistant Examiner*—Robert H. Muromoto, Jr.
(74) *Attorney, Agent, or Firm*—Finnegan, Henderson, Farabow, Garrett & Dunner, L.L.P.

(57) ABSTRACT

A main portion of a fastener tape is woven with transparent or semi-transparent synthetic fiber monofilament yarn as warp yarn and weft yarn. Plural flexible yarns are interwoven into a side edge portion of the fastener tape in a longitudinal direction of the tape so as to form a fastener-element-mounting portion for mounting fastener elements. The fastener-element-mounting portion may be formed of an interwoven portion having a flat surface, in which case continuous fastener elements are to be attached thereto. Alternatively, a swollen core portion may be formed on the surface of the fastener-element-mounting portion, in which case single-type separate fastener elements are to be attached thereto. As a flexible yarn, a finished yarn having a bulk and produced by textured processing multifilament yarn is used so that mounting of the fastener elements are facilitated and the configuration of the fastener tape is stabilized. Therefore, a fashionable fastener tape formed of transparent or semi-transparent woven fabric can be obtained.

8 Claims, 6 Drawing Sheets

SLIDE FASTENER TAPE

BACKGROUND OF THE INVENTION

1. Field of the Invention

The present invention relates to a slide fastener tape woven with transparent or semi-transparent monofilament yarn made of synthetic fibers, for warp yarn and weft yarn.

2. Description of the Related Art

It is conventionally known and reduced into practice that a slide fastener tape is woven with transparent or semi-transparent synthetic resin monofilament yarn, by using various kinds of warp knitting structures.

According to the British Patent No.1221114, as shown in FIG. 6, the fastener tape 1' is woven into a plane weave fabric structure with colorless synthetic fiber monofilament yarn, and coil-shaped fastener elements 14' formed of thermoplastic resin monofilament are woven into the woven structure of the fastener tape 1' at one side edge portion thereof so that stretching of the fastener tape 1' in a longitudinal direction thereof can be suppressed.

Conventionally, it is known that a slide fastener tape is knitted in a warp knitting structure using transparent or semi-transparent synthetic fiber monofilaments. However, in such a warp knitting structure, stretching in the longitudinal direction of the fastener tape is restricted by plural warp knitting patterns. Therefore, there is a problem that a large amount of materials is needed. Further, a transparent or semi-transparent fastener tape of a woven fabric structure is often demanded depending on a purpose of use of the fastener.

However, such a transparent or semi-transparent fastener tape of a woven fabric structure has not been realized. The reason is that such a transparent or semi-transparent fastener tape causes deviation of the weave pattern in the tape so that each interval of individual fastener elements becomes unstable. In a case of a slide fastener having a woven fabric structure as shown in FIG. 6, the fastener elements 14' are woven into the fabric so as to keep the intervals between the fastener elements constant thereby stabilizing its configuration. However, this fastener tape 1' cannot be used for every type of fastener elements.

SUMMARY OF THE INVENTION

Accordingly, the present invention has been achieved to solve the above described problems, and an object of the present invention is to provide a slide fastener tape which may be applied to attachment of every type of fastener elements for a slide fastener and is highly fashionable. More specifically it is to provide a slide fastener tape having a transparent or semi-transparent woven fabric structure which could not be achieved conventionally, which facilitates attachment of various types of fastener elements, whose configuration is stabilized and which may be applied to various types of slide fasteners.

Further, an object of the present invention is to provide a slide fastener tape having a woven fabric structure suitable for sewing and attaching fastener elements, more particularly, continuous coil-shaped type or continuous zigzag type fastener elements.

Furthermore, an object of the present invention is to provide a slide fastener tape having a woven fabric structure suitable for attaching fastener elements, more particularly, single-type separate fastener elements, for example, metallic fastener elements (coupling elements) or thermoplastic resin injection-molded or extruded fastener elements (coupling elements).

Still further, an object of the present invention is to provide a slide fastener tape having a sewing portion enabling to attach the fastener tape formed of a transparent or semi-transparent woven fabric structure to an object to be attached such as clothes easily and in a stabilized condition.

Still further, an object of the present invention is to provide a slide fastener tape, in which the kind of weaving yarn for a fastener-element-mounting portion is specified and which includes weaving yarn suitable for creating a woven fabric structure for sewing continuous coil-shaped type or continuous zigzag type fastener elements.

Still further, an object of the present invention is to provide a slide fastener tape, in which the kind of weaving yarn for a fastener-element-mounting portion is specified and which includes weaving yarn suitable for creating a woven fabric structure for sewing various types of fastener elements and capable of suppressing stretching of the tape in a longitudinal direction thereof.

Still further, an object of the present invention is to provide a slide fastener tape which enables to produce a core string suitable for attaching single-type separate fastener elements easily and which includes a core portion for mounting the elements on an edge portion of that woven fastener tape easily.

To achieve the above objects, according to a first aspect of the invention, there is provided a slide fastener tape woven with transparent or semi-transparent synthetic fiber monofilament yarn, which is made of polyamide base or polyester base, for warp yarn and weft yarn, wherein plural flexible yarns are woven in a side edge portion of the fastener tape in a longitudinal direction of the tape so as to form a fastener-element-mounting portion for attaching fastener elements.

Further, according to a second aspect of the invention, there is provided a slide fastener tape, wherein the fastener-element-mounting portion, in which the flexible yarns are interwoven in the side edge portion of the fastener tape and which is suitable for sewing and attaching continuous fastener elements, is formed of an interwoven portion where a surface of the tape is flat.

Furthermore, according to a third aspect of the invention, there is provided a slide fastener tape, wherein the fastener-element-mounting portion, in which the flexible yarns are interwoven into the side edge portion of the fastener tape and suitable for attaching single-type separate fastener elements, is formed of a core portion swollen from the surface of the tape.

Still further, according to a fourth aspect of the invention, there is provide a slide fastener tape, wherein the plural flexible yarns are interwoven into the side edge portion of the fastener tape on an opposite side to the fastener-element-mounting portion for mounting the fastener elements so as to form a sewing portion to be sewed onto an object to be attached such as clothes.

Still further, according to a fifth aspect of the invention, there is provided a slide fastener tape, wherein each of the flexible yarns is formed of a finished yarn produced by textured processing synthetic fiber multifilament yarn of polyamide base or polyester base.

Alternatively, according to a sixth aspect of the invention, there is provided a slide fastener tape, wherein each of the flexible yarns is formed of a twisted yarn produced by intertwining synthetic fiber multi-filament yarns of polyamide base or polyester base.

Further, according to a seventh aspect of the invention, there is provided a slide fastener tape wherein twisted yarns composed of synthetic fiber multi-filament yarn of polyamide base or polyester base are twisted, braided or doubled and assembled so as to form a core string, and the core string is interwoven into the side edge portion so as to form the core portion.

DESCRIPTION OF THE PREFERRED EMBODIMENTS

Hereinafter, the embodiments of a slide fastener tape of the present invention will be described in detail with reference to the accompanying drawings.

The slide fastener tape of the present invention is woven by means of a needle loom. In a main portion 4 of the fastener tape 1, transparent or semi-transparent synthetic fiber monofilament yarns of polyamide base or polyester base are disposed as warp yarns 2 and double-pick weft yarns 3 of its woven fabric structure so as to form a transparent or semi-transparent fastener tape 1.

Figure 1:
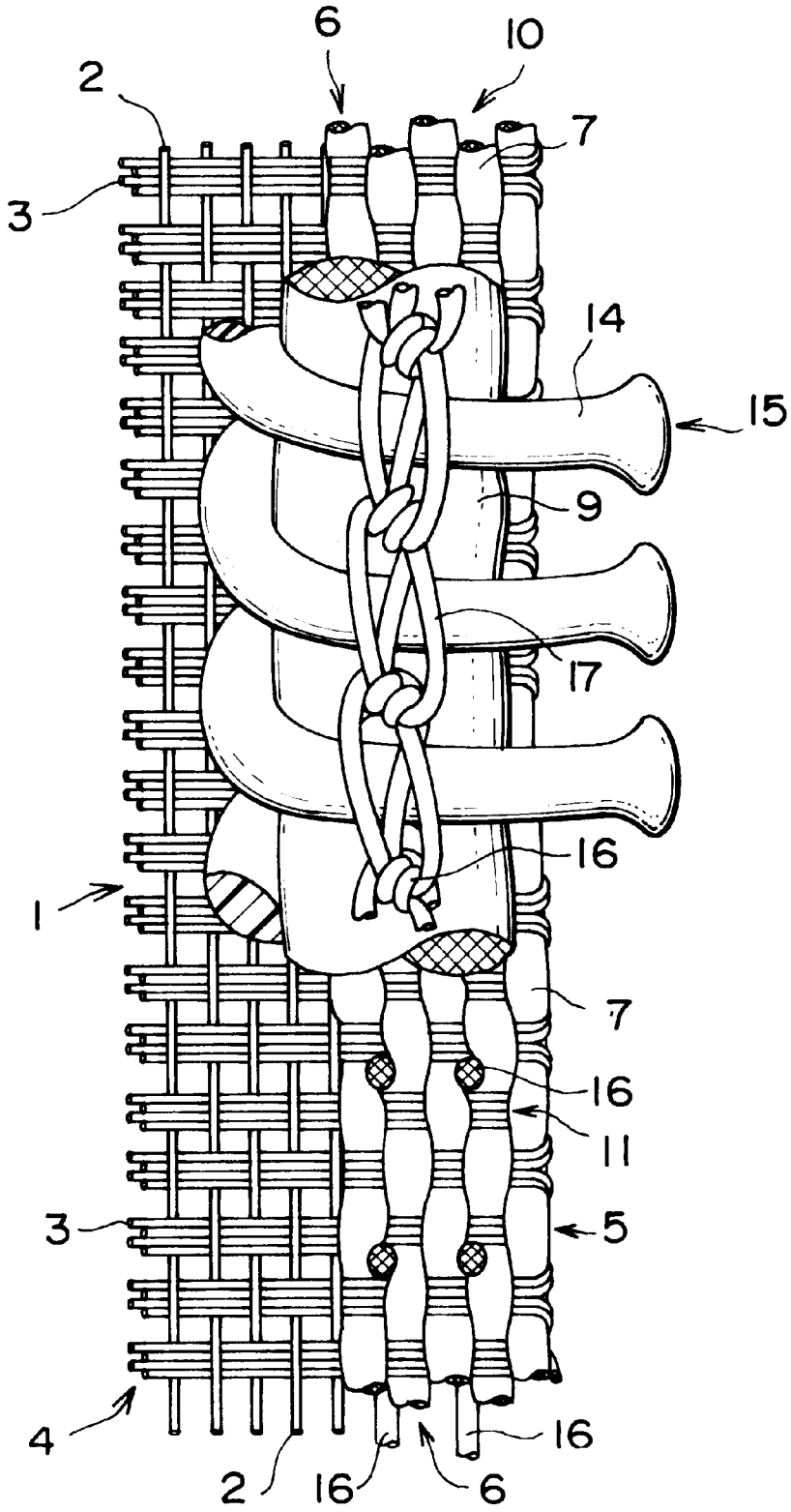
FIG. 1 is a front view of a major portion of a fastener stringer according to a first embodiment of the invention.
Figure 2:
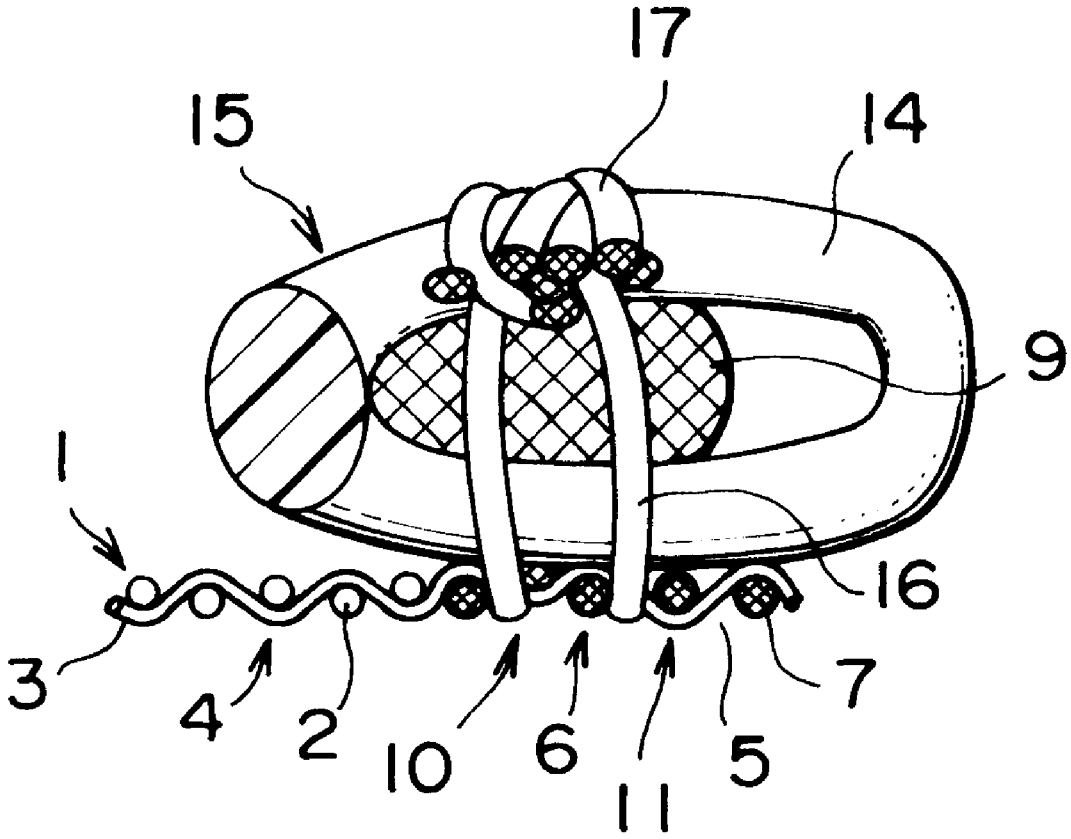
FIG. 2 is a lateral sectional view of the major portion of the fastener stringer.
Figure 3:
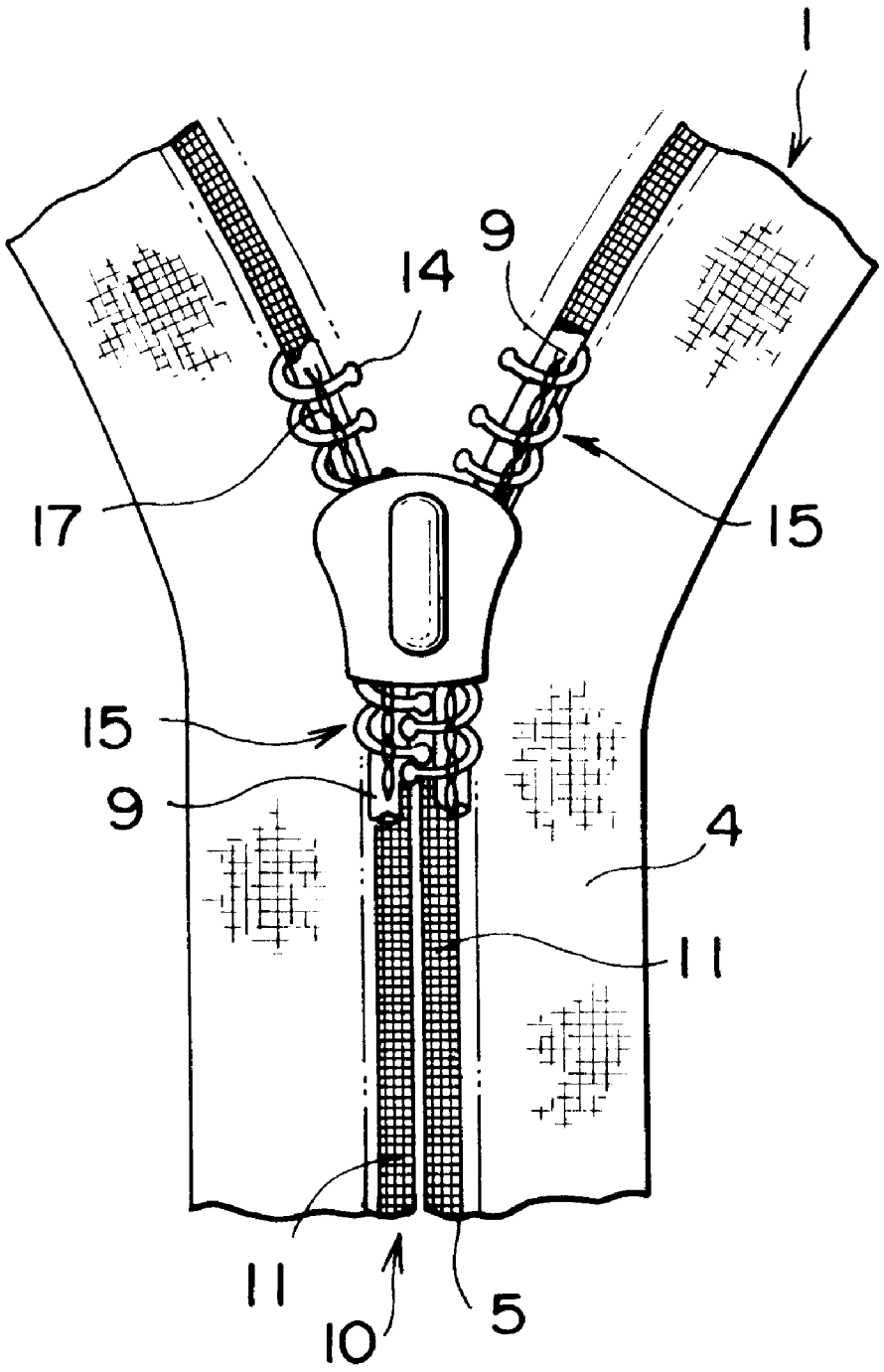
FIG. 3 is a front view of a fastener chain according to the first embodiment.

As shown in FIGS. 1 to 3, in the main portion 4 at a center of the fastener tape 1 according to the first embodiment, transparent or semi-transparent monofilament yarns, which are made of synthetic fibers of polyamide base such as nylon 6 or and nylon 66, or polyester base such as polyethylene telephthalate, are disposed as the warp yarns 2, and transparent or semi-transparent monofilament yarns, which are made of synthetic fibers of polyamide base or polyester base, are used for the weft yarns 3. The fastener tape 1 is woven by weft in-laiding the four weft yarns 3 while gripping the two weft yarns 3 by a crochet needle of the needle loom.

When the fastener tape 1 is woven by the needle loom, an interwoven portion 11 in which plural flexible yarns 6 as the warp yarns 2 are woven into a side edge portion 5 of the fastener tape 1 is provided. This interwoven portion 11 forms a fastener-element-mounting portion 10 for mounting fastener elements 14. Each of the flexible yarns 6 is composed of a finished yarn 7 having a bulk and formed by textured processing multi-filament yarn of synthetic fiber of polyamide base or polyester base. The yarn 6 is formed so as to be thicker than a warp yarn 2 made of monofilament yarn in the main portion 4 of the fastener tape 1. Meanwhile, a weaving width of the interwoven portion 11 may be increased or decreased for adjustment depending on a size of the fastener elements.

The fastener elements 14 to be mounted on the fastener-element-mounting portion 10 is produced by winding a thermoplastic monofilament of polyamide or polyester into a coil-shape, which is finished as shown in FIGS. 1 and 2. Then, a core string 9, which is formed by assembling synthetic fiber multi-filament twisted yarns 8 by twisting together or doubling, is inserted through the coil-shaped fastener elements 14 so as to form a coil-shaped fastener element row 15. The fastener element row 15 is placed on the fastener-element-mounting portion 10, which is formed of the interwoven portion 11 formed at the side edge portion 5 of the fastener tape 1 and having entirely a flat surface with a slight unevenness. Then, the core string 9 is pierced through the fastener element row 15, which is sewed onto the fastener tape 1 with multi-thread chain stitch by a sewing machine.

As described above, since the main portion 4 of the fastener tape 1 is woven of transparent or semi-transparent synthetic fiber monofilament yarns for the warp yarns 2 and the weft yarns 3, the fastener tape 1 becomes transparent or semi-transparent so that a uniquely fashionable fastener tape 1 can be obtained.

At the side edge portion 5 of the fastener tape 1, the finished yarns 7 textured processed each having a bulk are disposed in the longitudinal direction of the fastener tape 1 and tightened by groups of four weft yarns 3 made of synthetic fiber monofilament yarns so that an entirely flat surface but with a slight unevenness is formed. This surface serves to prevent the fastener element row 15 to be mounted from being slipped. Since the fastener element row 15 containing the core string 9 is sewed onto the fastener-element-mounting portion 10 formed of the interwoven portion 11 by multi-thread chain stitch sewing, the side edge portion 5 of the fastener tape 1 is prevented from being stretched in the longitudinal direction of the fastener tape 1 by needle yarn 16 and looper yarn 17. Further, the fastener element row 15 is suppressed in stretching in the longitudinal direction by friction between the fastener element row 15 and the interwoven portion 11 including the finished yarn 7 having a bulk, so that deviation of weave pattern in the fastener tape 1 is blocked securely.

Next, a modification of the interwoven portion 11 of the fastener tape 1 will be described. A twisted yarn 8 is produced by intertwining synthetic fiber multi-filament yarns of polyamide base or polyester base with the flexible yarns 6 and then, the twisted yarn 8 is disposed as a warp yarn 2 at the side edge portion 5 of the fastener tape 1. Then, this twisted yarn 8 is tightened and woven in by weft yarns 3 of synthetic fiber monofilament yarns, so that an interwoven portion 11 is formed. Consequently, a fastener-element-mounting portion 10 is formed. Although this interwoven portion 11 is entirely flat, its surface is provided with unevenness by the twisted yarns 8 so that the unevenness serves to prevent the fastener element row 15 to be mounted from being slipped out. Thus, the fastener-element-mounting portion 10 can be formed in a form suitable for sewing the continuous fastener element row.

Figure 4:
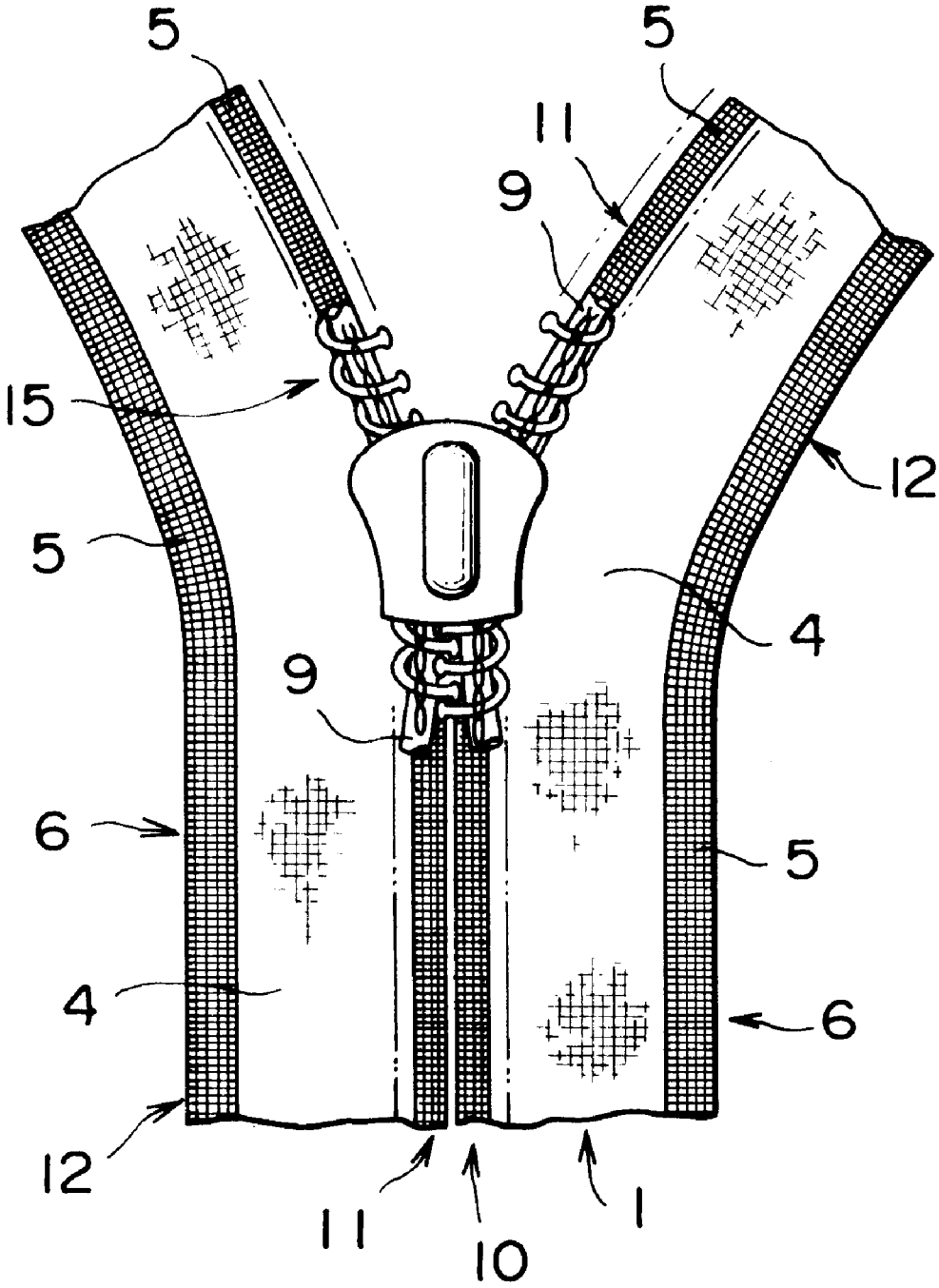
FIG. 4 is a front view showing a modification of the fastener chain.

In a fastener tape 1 of the second embodiment as shown in FIG. 4, a main portion 4 of the tape 1 and a side edge portion 5 at a side thereof are formed in the same manner as the first embodiment. That is, the main portion 4 of the fastener tape I uses transparent or semi-transparent synthetic fiber monofilament yarns for its warp yarns 2 and weft yarns 3, and a finished yarn 7 composed of synthetic fiber multi-filament yarn textured processed is woven in an interwoven portion 11. However, this fastener tape 1 is different from the fastener tape 1 of the first embodiment in that a sewing portion 12 for sewing the fastener tape 1 onto an object to be attached such as clothes is formed at a side edge portion 5 of the other side of the fastener tape 1.

In the fastener tape 1 of the second embodiment, plural flexible yarns 6 are woven into the sewing portion 12 formed at the side edge portion 5 of the other side in the longitudinal direction of the tape 1. As this flexible yarn 6, the finished yarn 7 having a bulk, which is made by textured processing synthetic fiber multi-filament yarn, is used likewise the yarn used in the interwoven portion 11. By providing the sewing portion 12 with a bulk, the sewing portion 12 can be in a form suitable for machine sewing so that it can be easily sewed onto an object to be attached such as clothes without any deviation of weave pattern in the fastener tape 1.

A weaving width of the sewing portion 12 formed at the side edge portion 5 of the fastener tape 1 is preferably larger than a weaving width of the interwoven portion 11 formed of a fastener-element-mounting portion 10 in which the flexible yarns 6 are interwoven, which facilitates sewing of the fastener tape 1 onto an object to be attached such as clothes.

Alternatively, the sewing portion 12 which is to be sewed onto an object to be attached such as clothes may be formed of twisted yarns 8 produced by twisting synthetic fiber multi-filament yarns for flexible yarns 6, which are interwoven in the side edge portion 5 with the weft yarns 3 of synthetic fiber monofilament yarns.

Figure 5:
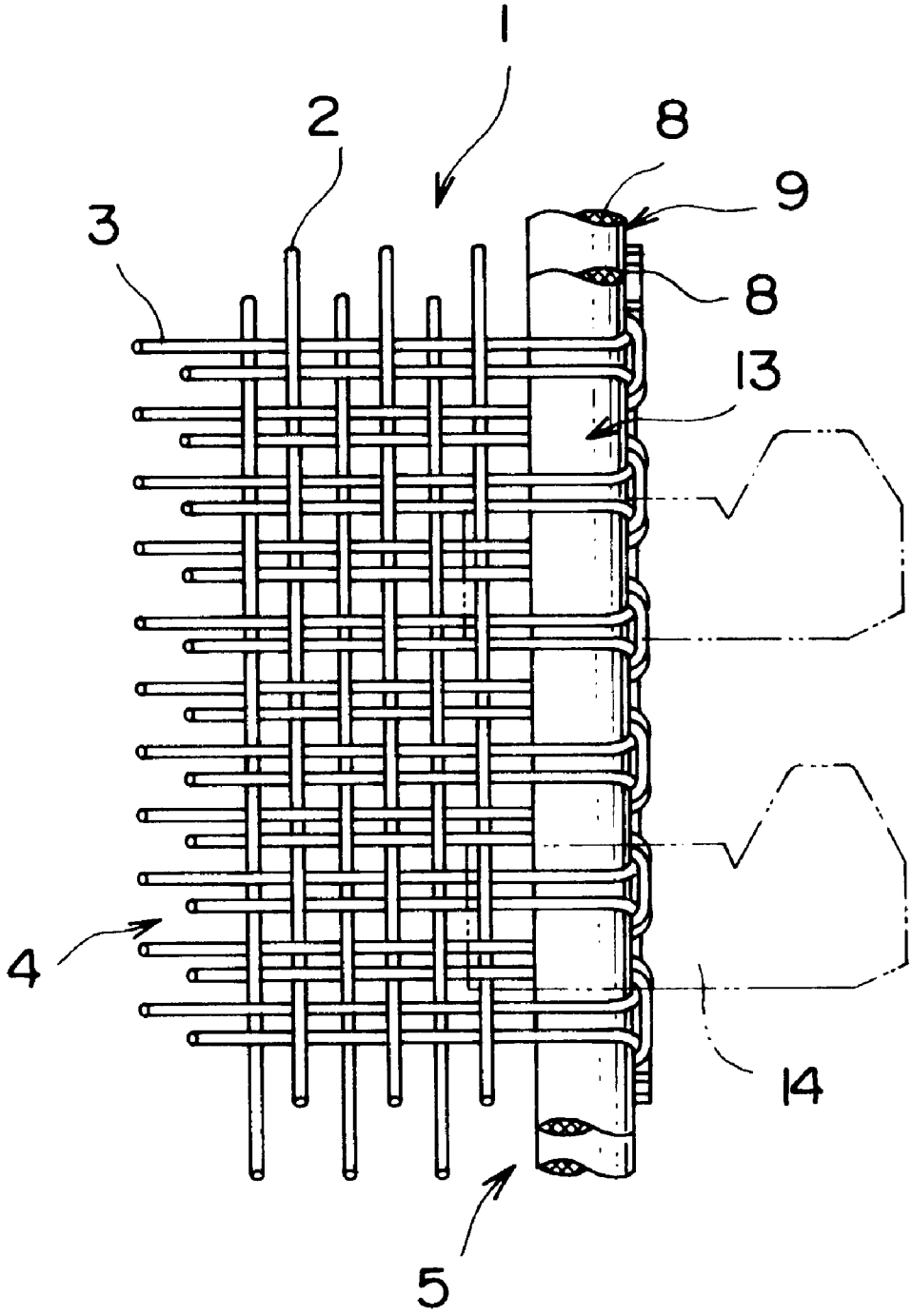
FIG. 5 is a front view of a major portion of a fastener tape according to a second embodiment of the invention.
Figure 6:
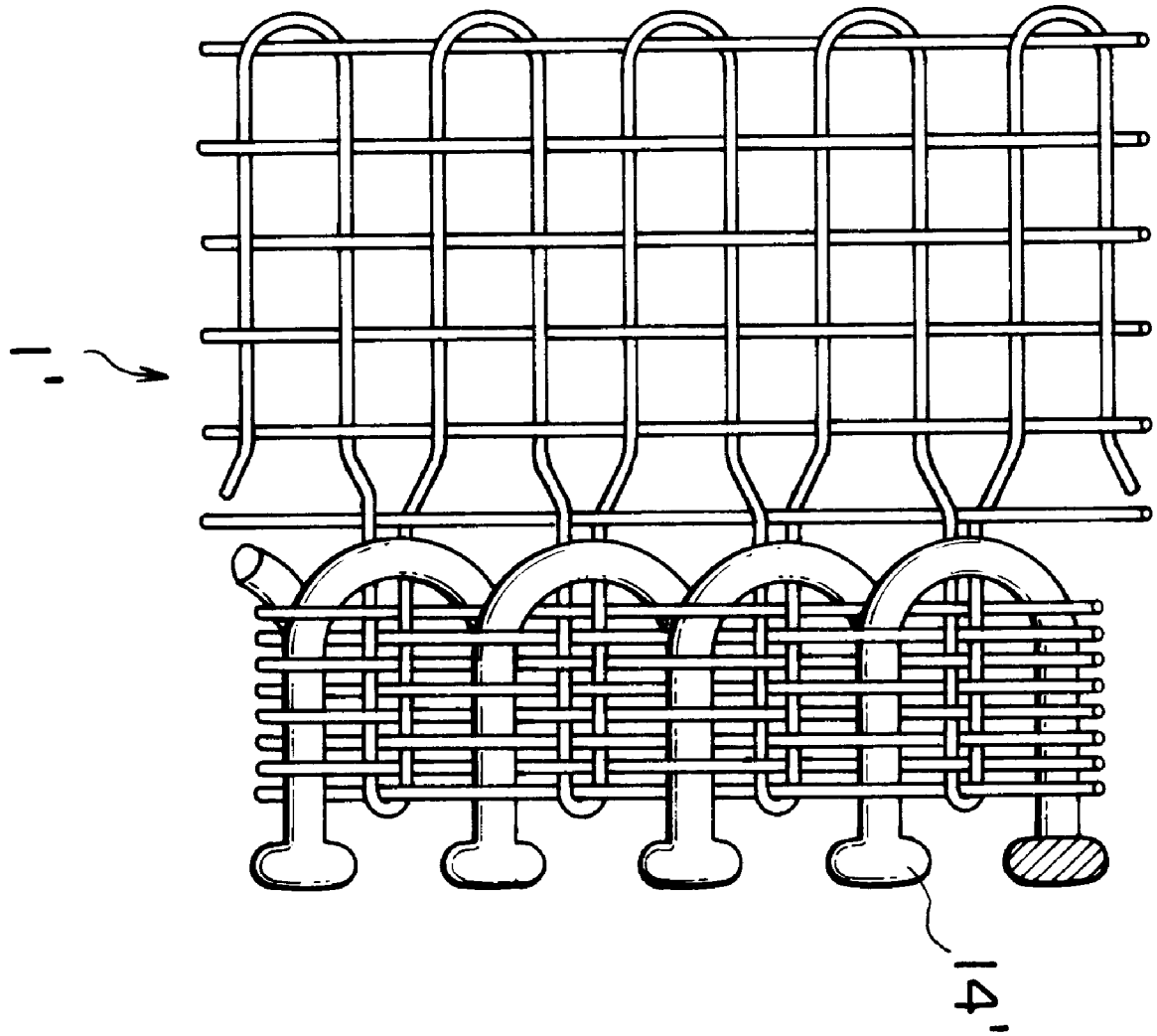
FIG. 6 PRIOR ART
FIG. 6 is a front view of a major portion of a known fastener stringer.

Finally, a fastener tape 1 of the third embodiment will be described with reference to FIG. 5. A main portion 4 of the fastener tape 1 is woven with transparent or semi-transparent synthetic fiber monofilament yarns for warp yarns 2 and weft yarns 3 by means of a needle loom, like the fastener tape 1 of the above-described respective embodiments. However, in this case, a core string 9 is formed at the side edge portion 5 on one side of the fastener tape 1, by intertwining or doubling and assembled plural twisted yarns 8 of multifilament yarns of polyamide base or polyester base, and then two of the core strings 9 are woven in with double-pick weft yarns 3 in such a manner that they are disposed on front and rear surfaces of the woven fabric structure by means of the needle loom. Thus, a core portion 13 which is swollen from the front and rear surfaces is formed to prevent deviation of the weft yarns 3 in a longitudinal direction of the fastener tape 1.

Single-type separate fastener elements 14, for example, metallic fastener elements 14 (coupling elements) are fixed by caulking to the swollen core portion 13 formed of the two core strings 9. Alternatively, single-type separate fastener elements 14 (coupling elements) may be integrally molded by injection molding or extruding thermoplastic resin and fixed to the core portion 13. The fastener tape 1 is suitable for producing such a fastener stringer.

The core portion 13 to be formed at the side edge portion 5 of the fastener tape 1 may be formed by weaving a core string 9 in a hollow weave structure with double-pick weft yarns 3. It is needless to say that a sewing portion 12 in the same manner as the second embodiment may be formed at a side edge portion 5 on an opposite side to the core portion 13.

The slide fastener tape of the present invention has the above-described structure and this structure provides the following advantageous effects.

According to the first aspect of the present invention, the slide fastener tape 1 is woven with transparent or semi-transparent synthetic fiber monofilament yarns as warp yarns 2 and weft yarns 3, such that plural flexible yarns 6 are woven into a side edge portion 5 of the fastener tape 1 in a longitudinal direction of the tape 1 so as to form a fastener-element-mounting portion 10. Therefore, the slide fastener tape 1 can be applied to attachment of every type of fastener elements. Further, since this is a fastener tape 1 having transparent or semi-transparent woven fabric, it is highly fashionable, various types of fastener elements can be attached thereto easily, and a fastener tape 1 stabilized in its configuration can be achieved easily.

Further, according to the second aspect of the present invention, the fastener-element-mounting portion 10 in which the flexible yarns 6 are interwoven is formed of a flat interwoven portion 11. Therefore, a continuous coil shaped or continuous zigzag shaped fastener element row can be attached in a stabilized configuration.

Furthermore, according to the third aspect of the present invention, the fastener-element-mounting portion 10 in which the flexible yarns 6 are interwoven is formed of a swollen core portion 13. Therefore, single-type separate fastener elements, for example, metallic fastener elements can be attached and fixed easily by caulking, or thermoplastic resin fastener elements can be integrally molded and fixed thereto easily by injection molding or extrusion.

Still further, according to the fourth aspect of the present invention, the flexible plural yarns 6 are interwoven into the side edge portion 5 of the fastener tape 1 on an opposite side to the fastener-element-mounting portion 10 so as to form a sewing portion 12 to be sewed onto an object to be attached such as clothes. Therefore, the transparent or semi-transparent woven fabric fastener tape 1 can be sewed easily onto the object to be attached such as clothes in a stabilized condition.

Still further, according to the fifth aspect of the present invention, each of the flexible yarns 6 is formed of a finished yarn 7 produced by textured processing synthetic fiber multi-filament yarn. Therefore, this slide fastener tape 1 that includes weaving yarns suitable for a woven fabric structure on which continuous coil shaped fastener elements or continuous zigzag fastener elements can be attached easily can be obtained.

Still further, according to the sixth aspect of the present invention, each of the flexible yarns 6 is formed of a twisted yarn 8 produced by intertwining synthetic fiber multi-filament yarns. Therefore, various types of fastener elements can be sewed onto the fastener tape 1 easily, and further, a slide fastener tape 1 that includes weaving yarns suitable for a woven fabric structure capable of suppressing stretching of the fastener tape in the longitudinal direction thereof can be obtained.

Still further, according to the seventh aspect of the present invention, the twisted yarns 8 composed of synthetic fiber multi-filament yarns are assembled to form a core string 9, and the core string 9 is interwoven into the side edge portion 5 so as to form the core portion 13. Therefore, single-type separate metallic fastener elements or single-type separate fastener elements made of thermoplastic resin can be attached to the fastener tape 1 easily.

What is claimed is:

1. A slide fastener tape woven with transparent or semi-transparent synthetic resin monofilament yarn as warp yarn and weft yarn, wherein plural yarns having more flexibility than said warp yarn and weft yarn are woven into a side edge portion of the fastener tape in a longitudinal direction of the tape so as to form a fastener-element-mounting portion.

2. A slide fastener tape according to claim 1, wherein the fastener-element-mounting portion in which the flexible yarns are interwoven is formed of a flat interwoven portion.

3. A slide fastener tape according to claim 1, wherein the fastener-element-mounting portion in which the flexible yarns are interwoven is formed of a swollen core portion.

4. A slide fastener tape according to claim 1, wherein the plural flexible yarns are interwoven into the side edge portion of the fastener tape on an opposite side to the fastener-element-mounting portion so as to form a sewing portion to be sewed onto an object to be attached.

5. A slide fastener tape according to claim 1, wherein each of the flexible yarns is formed of synthetic resin multi-filament yarn.

6. A slide fastener tape according to claim 1, wherein each of the flexible yarns is formed of a twisted yarn of synthetic resin multi-filament yarns.

7. A slide fastener tape according to claim 1, wherein yarns having said flexibility form a core string composed of plural twisted yarns of synthetic resin multi-filament yarns, and said core string is woven into said fastener-element-mounting portion.

8. A slide fastener tape according to claim 1, wherein said warp yarn and said weft yarn are transparent or semi-transparent.

* * * * *